US006155888A

United States Patent [19]

Kurimoto

[11] Patent Number: 6,155,888

[45] Date of Patent: Dec. 5, 2000

[54] WATER-PROOF CONNECTOR

[75] Inventor: Naoya Kurimoto, Yokkaichi, Japan

[73] Assignee: Sumitomo Wiring Systems, Ltd., Japan

[21] Appl. No.: 09/455,797

[22] Filed: Dec. 7, 1999

[30] Foreign Application Priority Data

Dec. 9, 1998 [JP] Japan ..... 10-350348

[51] Int. Cl.[7] ..... H01R 13/514

[52] U.S. Cl. ..... 439/752; 439/595

[58] Field of Search ..... 439/752, 595

[56] References Cited

U.S. PATENT DOCUMENTS

| | | | |
|---|---|---|---|
| 5,595,509 | 1/1997 | Fry et al. | 439/595 |
| 5,692,929 | 12/1997 | Hoffmann | 439/752 |
| 5,954,546 | 9/1999 | Fink et al. | 439/752 |
| 6,071,153 | 6/2000 | Fink et al. | 439/752 |

*Primary Examiner*—Paula Bradley
*Assistant Examiner*—Tho D. Ta
*Attorney, Agent, or Firm*—Banner & Witcoff, Ltd.

[57] ABSTRACT

A female housing 1 has a form in which a hood 3 surrounds an anterior end of a housing main body 2 provided with cavities 5A and 5B, and sealing rings 10 fit with an outer circumference of the housing main body 2 within an inner end of the hood 3. A retainer insertion groove 23 is formed on a side face of the housing main body 2 at a location to the anterior of the location where the sealing rings 10 are installed. A retainer 14 is inserted into this retainer insertion groove 23 via a window which opens into the hood 3. This retainer 14 is maintained in a temporary stopping position which allows the insertion of female terminal fittings 6A and 6B, and in a main stopping position whereby the retainer 14 engages stepped members 9 of the female terminal fittings 6A and 6B. An operating member 21 of the retainer 14 protrudes to an anterior face of the housing main body 2 and allows the retainer 14 to be moved from this anterior face side.

10 Claims, 8 Drawing Sheets

WATER-PROOF CONNECTOR

TECHNICAL FIELD

The present invention relates to a water-proof electrical connector provided with a retainer.

BACKGROUND TO THE INVENTION

One type of electrical connector has a side retainer. In this type of connector, terminal fittings are doubly stopped in an unremovable state. A retainer is inserted from a side face of a housing provided with a plurality of cavities, this retainer being retained by stepped members or the like formed on the terminal fittings that have been inserted into these cavities. Consequently, the terminal fittings can be engaged directly, and this type of connector has the advantage of having a strong retaining force.

However, in the case of water-proof connectors, an outer circumference of a housing is provided with a hood member and, in order to make this type of connector suitable for a side retainer, a window must open into this hood member to allow the insertion of the retainer. This opening cannot easily be water-proofed, and side retainers are thus not usually employed for water-proof connectors.

A water-proof connector which employs a side retainer without having such a window to allow the insertion of the retainer is proposed in U.S. Pat. No. 5,692,929.

In this connector, the retainer is formed in a shape capable of covering the circumference of an anterior end of a housing provided with cavities. The retainer is inserted into the housing so as to cover an anterior face thereof and has a configuration whereby it can be moved between a temporary stopping position and a main stopping position, the direction of this movement intersecting with the direction of insertion of the terminal fittings. In the temporary stopping position, fitting members provided on the retainer move towards sides of the cavities, thereby allowing the terminal fittings to be inserted. In the main stopping position, the fitting members protrude into the cavities, thereby retaining the terminal fittings in an unremovable state.

However, in the connector described above, the retainer has a configuration whereby it is covered by the outer side of the housing and. moreover, a space is required between the housing and a surrounding hood member to allow the covered retainer to move in a radial direction. As a result. there is the problem that the entire connector must be large.

The present invention has been developed after taking the above problem into consideration, and aims to present a water-proof connector provided with a side retainer and capable of being miniaturised.

SUMMARY OF THE INVENTION

According to the invention there is provided an electrical connector comprising a housing having a plurality of parallel terminal cavities therein, each of said cavities being adapted to receive one of a plurality of electrical terminals, the housing having a retainer cavity intersecting said terminal cavities, and a retainer within said retainer cavity and movable between a first position in which in use said terminals can move in respective terminal cavities, and a second position in which said terminals are in use latched in respective terminal cavities, and the housing further including a hood extending parallel to said terminal cavities and surrounding said housing at a distance to define an annular chamber adapted to receive a corresponding annular projection of a mating housing, said hood having a window therein, aligned with said retainer cavity and adapted to receive said retainer therethrough.

Since the retainer of such a connector is wholly within the housing, the overall size of the connector is not increased. The window permits insertion of the retainer, and is of course closed when the tubular projection of a mating connector is received within the hood.

Preferably a close fitting seal is provided in the annular chamber in order to water-proof the connection between two mating connectors. The end of the annular chamber is preferably blind, and provides an end stop for the seal.

In the preferred embodiment the retainer has stopping members thereon, these stopping members being at the side of the terminal cavities in the first position, and protruding into the terminal cavities in the second position. The retainer may be castellated, and have a projection and recess associated with each terminal cavity. The retainer may further include a latch, for example a cantilevered resilient arm, to maintain the retainer in either of the first and second positions. The retainer and retainer cavity preferably have a substantially 'T' shaped section to ensure correct insertion thereof.

The retainer may have a discontinuity facing the mouth of the housing such that a mating discontinuity of another connector engages therewith. Such an arrangement ensures that mating connectors can be fully engaged only when such discontinuities engage. Accordingly movement of the retainer to the second position is checked.

BRIEF DESCRIPTION OF DRAWINGS

Other features of the invention will be apparent from the following description of a preferred embodiment shown by way of example only in the accompanying drawings, in which.

DESCRIPTION OF PREFERRED EMBODIMENT

An embodiment of the present invention is described below with the aid of FIGS. 1 to 17. The present embodiment is provided with a pair of hybrid male and female water-proof connectors capable of fitting mutually together. Firstly the female connector F will be explained with the aid of FIGS. 1 to 10.

Figure 1:
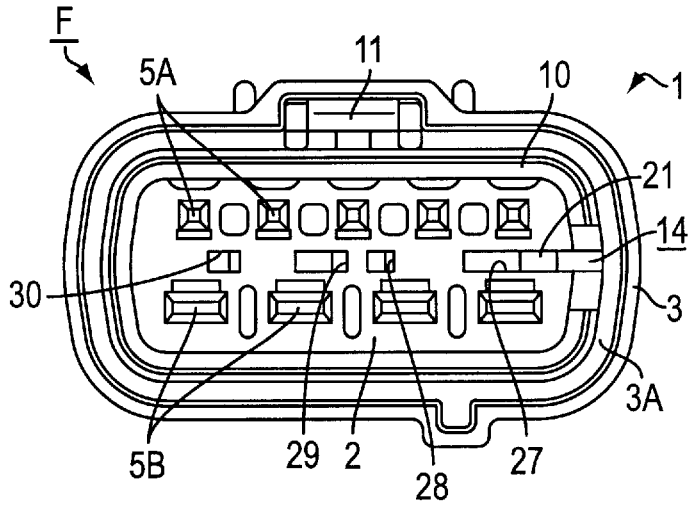
FIG. 1 is a front view of a female connector of an embodiment of the present invention.
Figure 3:
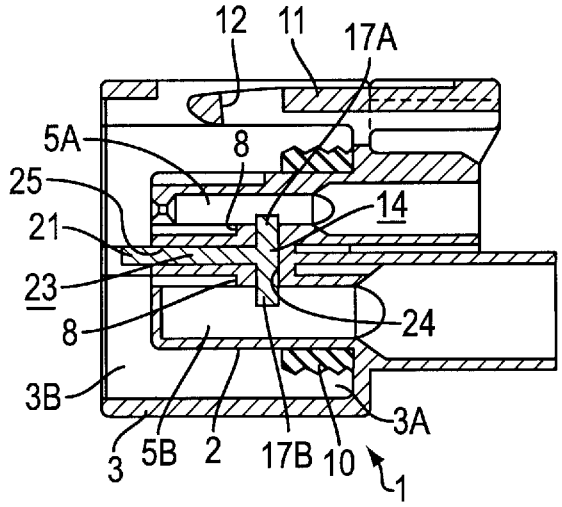
FIG. 3 is a vertical cross-sectional corresponding to FIG. 2.

The female connector F has a female housing 1 formed from plastic and, as shown in FIGS. 1 and 3, this comprises a housing main body 2 which has a cross-sectionally oblong shape and a hood member 3 which surrounds the circumference of the anterior end of the housing main body 2 to define an annular chamber 3A with a mouth 3B.

Five small cavities 5A are formed in an aligned manner at an upper level within the housing main body 2, and four large cavities 5B are formed in an aligned manner at a lower level within the housing main body 2. Small female terminal fittings 6A are inserted into the small cavities 5A, and large female terminal fittings 6B are inserted into the large cavities 5B, these terminal fittings 6A and 6B being inserted from a posterior direction so as to be above one another (see FIG. 10). A metal lance 7 provided on each of these terminal fittings 6A and 6B fits into a stopping groove 8 provided on a side wall of each cavity 5A and 5B, thereby stopping and housing the terminal fittings 6A and 6B in an unremovable state.

A sealing ring 10 is provided on an outer circumference face of the housing main body 2 at a location corresponding to inner edges of the hood member 3, and a locking arm 11 is formed on an upper face of the hood member 3. As a result, when a corresponding male connector M is fitted with the housing main body 2 (as will be described later), a cylindrical fitting member 42 of a male housing 41 advances to a correct position inside the hood member 3, whereupon the sealing ring 10 is gripped resiliently between the cylindrical fitting member 42 and the housing main body 2, thereby creating a seal therebetween. A protrusion 43 on the male housing 41 fits into a stopping hole 12 of a locking arm 11, thereby latching the two connectors F and M in a fitted state.

Figure 4:
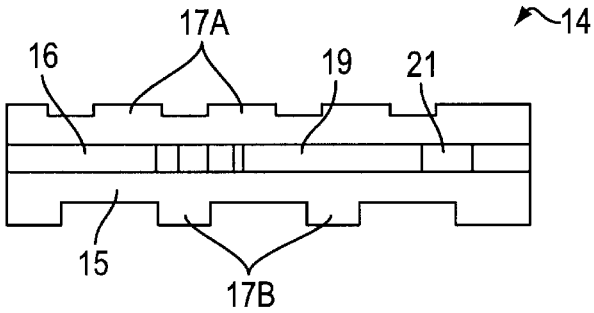
FIG. 4 is a plan view of a retainer.
Figure 5:
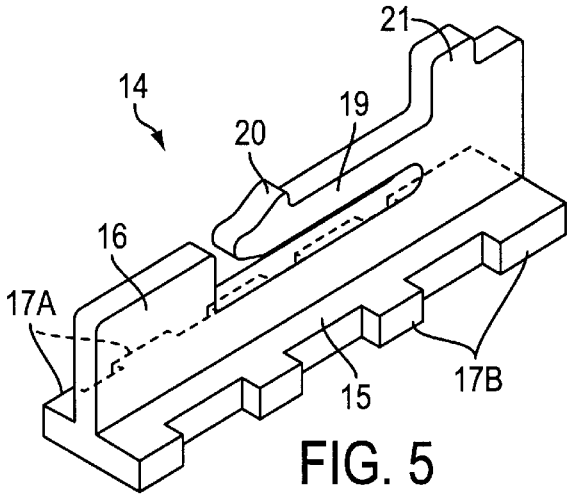
FIG. 5 is a diagonal view of the retainer of FIG. 4.

A retainer 14 can be installed on the housing main body 2 in order to doubly stop the female terminal fittings 6A and 6B. The retainer 14 is made from plastic and is formed as shown in FIGS. 4 and 5. Specifically, the retainer 14 has a length slightly shorter than the width of the housing main body 2 and a guiding plate 16 protrudes at a right angle from a central position, in a width-wise direction, of a base plate 15, thus forming a cross-sectional T-shape. Five stopping protrusions 17A are formed on one edge of the base plate 15, these stopping protrusions 17A engaging stepped members 9 of the small female terminal fittings 6A. Four stopping protrusions 17B are formed on the other edge of the base plate 15, these stopping protrusions 17B engaging stepped members 9 of the large female terminal fittings 6B.

A resilient stopping member 19 is formed on approximately the central portion, in a length-wise direction, of the protruding edge of the guiding plate 16. This resilient stopping member 19 is capable of bending and has a cantilevered shape formed towards an anterior direction relative to the direction of insertion (left in FIG. 6). A fitting protrusion 20 is formed on an upper face of a tip thereof. Furthermore, an operating member 21 protrudes from a base end of the resilient stopping member 19.

A retainer insertion groove 23, to allow the insertion of the retainer 14, is formed on a short side face on one end of the housing main body 2. More specifically, this retainer insertion groove 23 is formed between the upper and lower rows of cavities 5A and 5B and faces a direction intersecting with the direction of insertion of the female terminal fittings 6A and 6B. The retainer insertion groove 23 also has a cross-sectional T-shape. A base plate insertion space 24 into which the base plate 15 of the retainer 14 is inserted is provided to the anterior of the location where the sealing ring 10 is installed. Upper and lower edges of the base plate insertion space 24 are in the vicinity of the upper and lower cavities 5A and 5B.

Figure 6:
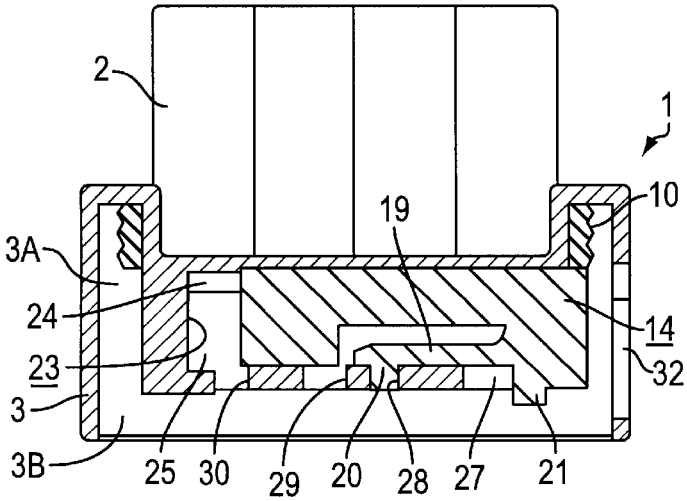
FIG. 6 is a cross-sectional view showing the retainer in a temporary stopping position.

As shown in FIGS. 1 and 6, the guiding plate 16 of the retainer 14 is guided into a guiding plate insertion space 25, an anterior face of this guiding plate insertion space 25 having formed thereon (in sequence in the direction of insertion of the retainer 14): a sliding hole 27 in which the operating member 21 can slide when it is in a state whereby it protrudes towards the anterior face of the housing main body 2; a temporary stopping hole 28 and a main stopping hole 29, into which the fitting protrusion 20 can be fitted in turn; and a detecting hole 30 into which an operating member 21 of a retainer 14 provided on the corresponding male connector M can be fitted.

Figure 2:
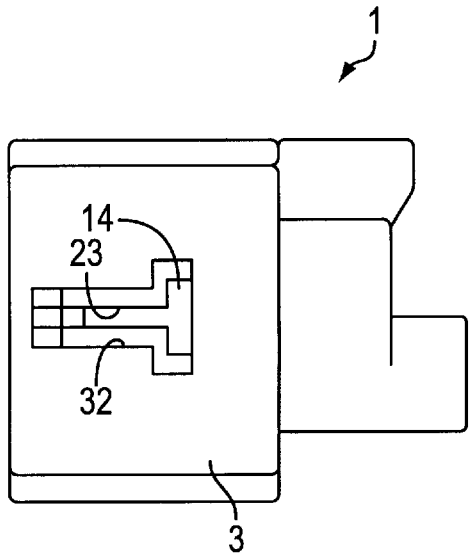
FIG. 2 is a side view corresponding to FIG. 1.

As shown in FIG. 2, a T-shaped window 32 opens onto a side face of the hood member 3 at a location corresponding to an outer side of an insertion hole of the retainer insertion groove 23, this window 32 being larger than the retainer insertion groove 23 and allowing the retainer 14 to be inserted towards the retainer insertion groove 23.

Furthermore, the operating member 21 protrudes towards the anterior face of the housing main body 2 and, consequently, a finger or a jig can be inserted from this anterior face to engage the operating member 21 and thereby move the retainer 14.

Figure 7:
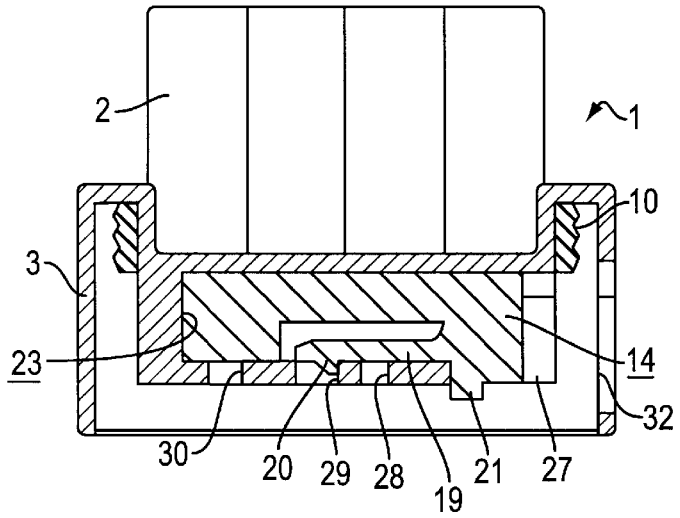
FIG. 7 is a cross-sectional view showing the retainer in a main stopping position.
Figure 8:
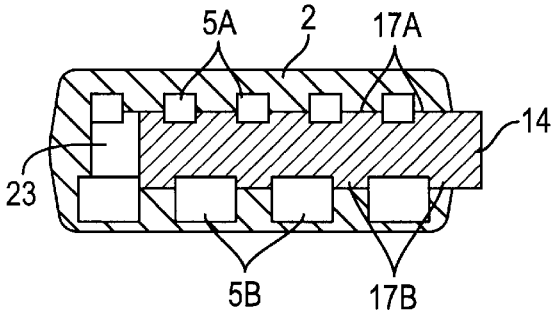
FIG. 8 is a schematic cross-sectional view of the retainer in the temporary stopping position.
Figure 9:
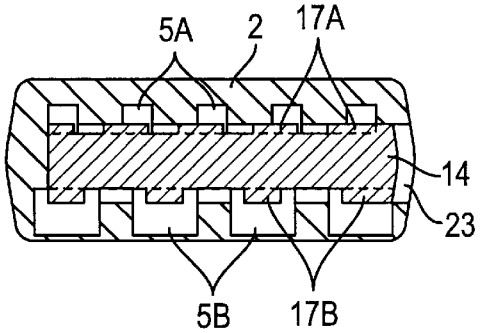
FIG. 9 is a schematic cross-sectional view of the retainer in the main stopping position.

As shown in FIG. 6, when the retainer 14 is inserted by being passed through the window 32 of the hood member 3 into the retainer insertion groove 23 of the housing main body 2, the fitting protrusion 20 of the resilient stopping member 19 fits with the temporary stopping hole 28 (located to the anterior relative to the direction of insertion) and is maintained therein in a temporary stopping position. In this temporary stopping position, as shown in FIG. 8, the stopping protrusions 17A and 17B of the base plate 15 of the retainer 14 are in a state whereby they are moved away from the cavities 5A and 5B. When the retainer 14 is pushed in further from the temporary stopping position, as shown in FIG. 7, the fitting protrusion 20 of the resilient stopping member 19 fits into the main stopping hole 29 (located farther inwards relative to the direction of insertion) and is maintained therein in a main stopping position. In this main stopping position, as shown in FIG. 9, the stopping protrusions 17A and 17B of the base plate 15 of the retainer 14 protrude into the cavities 5A and 5B.

Next, the corresponding male connector M will be explained with the aid of FIGS. 11 to 14. The male connector M is a panel mounted connector made from plastic and provided with the male housing 41. The cylindrical fitting member 42 is formed on an anterior face of the male housing 41, this cylindrical fitting member 42 fitting tightly with an inner side of the hood member 3 of the female housing 1. A terminal housing member 44, formed separately from plastic, is installed at an innermost end within the cylindrical fitting member 42.

Five small cavities 45A are formed in an aligned manner at an upper level within the terminal housing member 44, and four large cavities 45B are formed in an aligned manner at a lower level within this terminal housing member 44.

When the terminal housing member 44 is pushed to the innermost end within the cylindrical fitting member 42, stopping claws 46 provided on upper and lower faces of the terminal housing member 44 are engaged by, respectively, a stopping protruding member 47 and a stopping groove member 48 formed on upper and lower inner walls of the cylindrical fitting member 42, and are maintained in an unremovable state. Furthermore, terminal through holes 50 are formed on portions protruding from a posterior end of the cylindrical fitting member 42, these terminal through holes 50 passing through to the upper and lower cavities 45A and 45B.

Small male terminal fittings 66A and large male terminal fittings 66B (shown by the chain line in FIG. 12) are inserted into the small cavities 45A and the large cavities 45B respectively, these terminal fittings 66A and 66B being inserted from the posterior via the terminal through holes 50 and being mutually opposite. A metal lance 67 provided on each of these terminal fittings 66A and 66B fits into a stopping groove 52 provided on a side wall of each cavity 45A and 45B, thereby retaining and housing the male terminal fittings 66A and 66B in an unremovable state in which tabs 68 protrude into the cylindrical fitting member 42. (The male terminal fittings 66A and 66B are omitted in Figures other than FIG. 12).

A retainer 14 is installed on the terminal housing member 44 in order to doubly stop the male terminal fittings 66A and 66B. This retainer 14 is identical with the retainer 14 installed on the female connector F, and a retainer insertion groove 23 is formed in a short side face of one end of the terminal housing member 44 and faces a direction that is laterally symmetrical to the retainer insertion groove 23 of the female connector F. This retainer 14 and retainer insertion groove 23 are identical in form with those of the female connector F, and accordingly their components have been accorded the same numbers and an explanation thereof is omitted.

Before the terminal housing member 44 is installed within the cylindrical fitting member 42 of the male housing 41, the retainer 14 is inserted into the retainer insertion groove 23 of the terminal housing member 44 while this terminal housing member 44 is still at the exterior, and a fitting protrusion 20 of a resilient stopping member 19 first fits into a temporary stopping hole 28 and is maintained therein in a temporary stopping position. In this temporary stopping position, stopping protrusions 17A and 17B of a base plate 15 of the retainer 14 are in a state whereby they are moved away from the cavities 45A and 45B. The terminal housing member 44 is installed within the cylindrical fitting member 42 while the retainer 14 is maintained in the temporary stopping position and then, after the male terminal fittings 66A and 66B have been housed within the cavities 45A and 45B, the retainer 14 is pushed in towards a main stopping position. In this main stopping position, the fitting protrusion 20 of the resilient stopping member 19 fits into a main stopping hole 29 and is maintained therein in the main stopping position, and the stopping protrusions 17A and 17B of the base plate 15 of the retainer 14 protrude into the cavities 45A and 45B.

Figure 13:
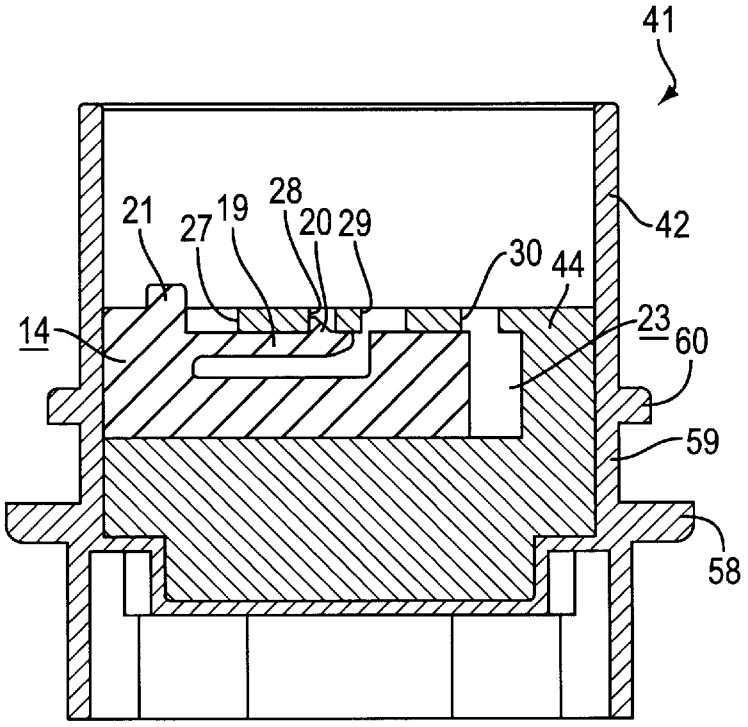
FIG. 13 is a cross-sectional view of the retainer in the temporary stopping position.
Figure 14:
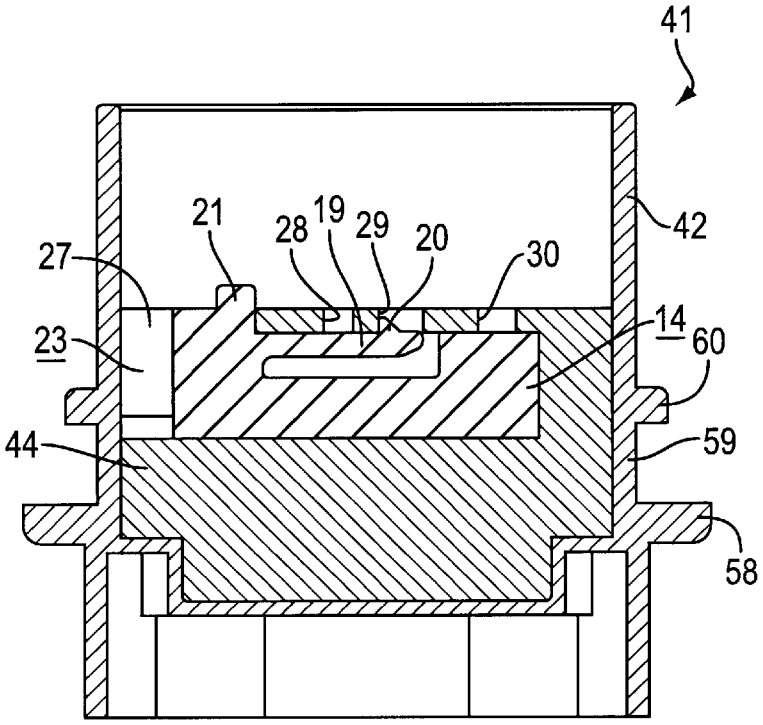
FIG. 14 is a plane cross-sectional view of the retainer in the main stopping position.

As shown in FIGS. 13 and 14, an operating member 21 provided on the retainer 14 protrudes from an anterior face of the terminal housing member 44. A finger or a jig can be inserted into the cylindrical fitting member 42 to engage the operating member 21, thereby enabling the retainer 14 to be moved from this anterior face. Furthermore, when the retainer 14 of the male connector M is in the main stopping position, the operating member 21 of the retainer 14 corresponds with the detecting hole 30 opening onto the anterior face of the housing main body 2 of the female connector F and is capable of fitting therewith.

Likewise, when the retainer 14 of the female connector F is in the main stopping position, the operating member 21 of the retainer 14 corresponds with a detecting hole 30 opening onto the anterior face of the terminal housing member 44 installed in the male connector M and is capable of fitting therewith.

Figure 11:
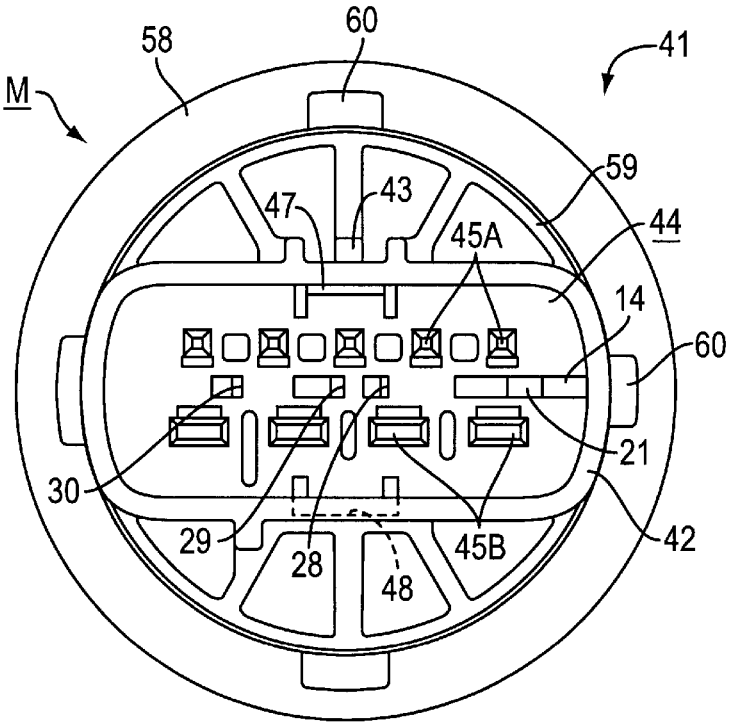
FIG. 11 is a front view of a male connector.
Figure 12:
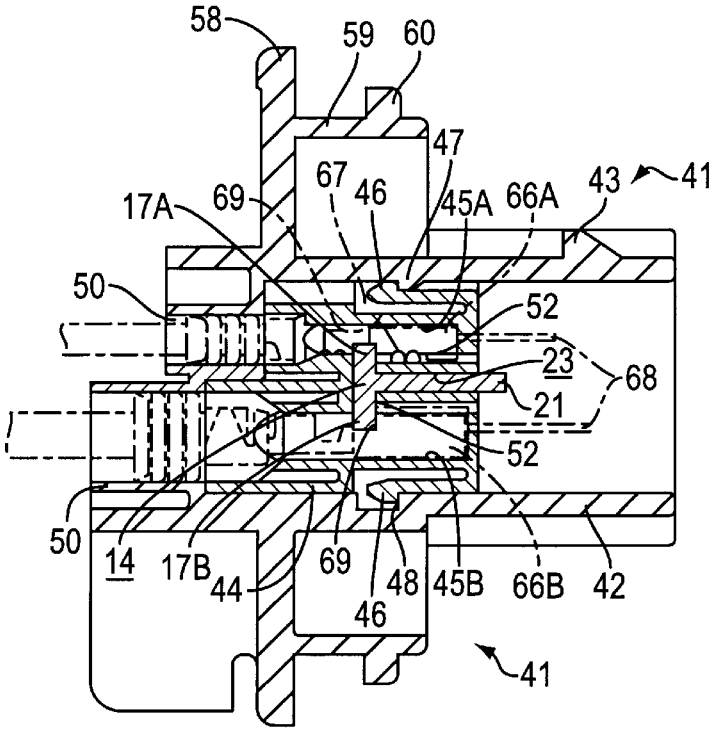
FIG. 12 is a vertical cross-sectional view of the male connector.

The male connector M can be attached to an attachment hole 56 of a panel 55 (see FIG. 15) and, as shown in FIGS. 11 and 12, a flange 58 is provided at an outer circumference of a posterior end of the cylindrical fitting member 42 and a circular wall 59 protrudes from an anterior face of this flange 58 and fits with the interior of the attachment hole 56. Protruding members 60, mutually separated at 90° angles, protrude from an outer circumference of the circular wall 59, these protruding members 60 being inserted into recessed grooves formed by cutting into a hole edge of the attachment hole 56.

Next, the operation of the present embodiment, configured as described above, will be explained.

The male connector M is assembled as follows. First, the retainer 14 is inserted into the retainer attachment groove 23 of the terminal housing member 44 and is maintained in the temporary stopping position. In this state, the terminal housing member 44 is pushed into the cylindrical fitting member 42 of the male housing 41 and, as shown in FIG. 12, the stopping claws 46 provided on the upper and lower faces of the terminal housing member 44 are stopped resiliently by the stopping protruding member 47 or the stopping groove member 48 and are maintained therein in an unremovable state (see FIG. 13). Next, the small male terminal fittings 66A and the large male terminal fittings 66B are inserted into the upper and lower cavities 45A and 45B via the terminal through holes 50 located at the posterior end, are stopped by the metal lances 67, and the male terminal fittings 66A and 66B are housed in the upper and lower cavities 45A and 45B.

Next, a finger or a jig is inserted into the cylindrical fitting member 42 from the anterior face side to engage the operating member 21 and (as shown in FIG. 14) to move the retainer 14 to the main stopping position. As a result, the stopping protrusions 17A and 17B of the retainer 14 protrude into the cavities 45A and 45B and engage posterior faces of stepped members 69 of the male terminal fittings 66A and 66B, thereby doubly stopping the male terminal fittings 66A and 66B in an unremovable state.

Figure 15:
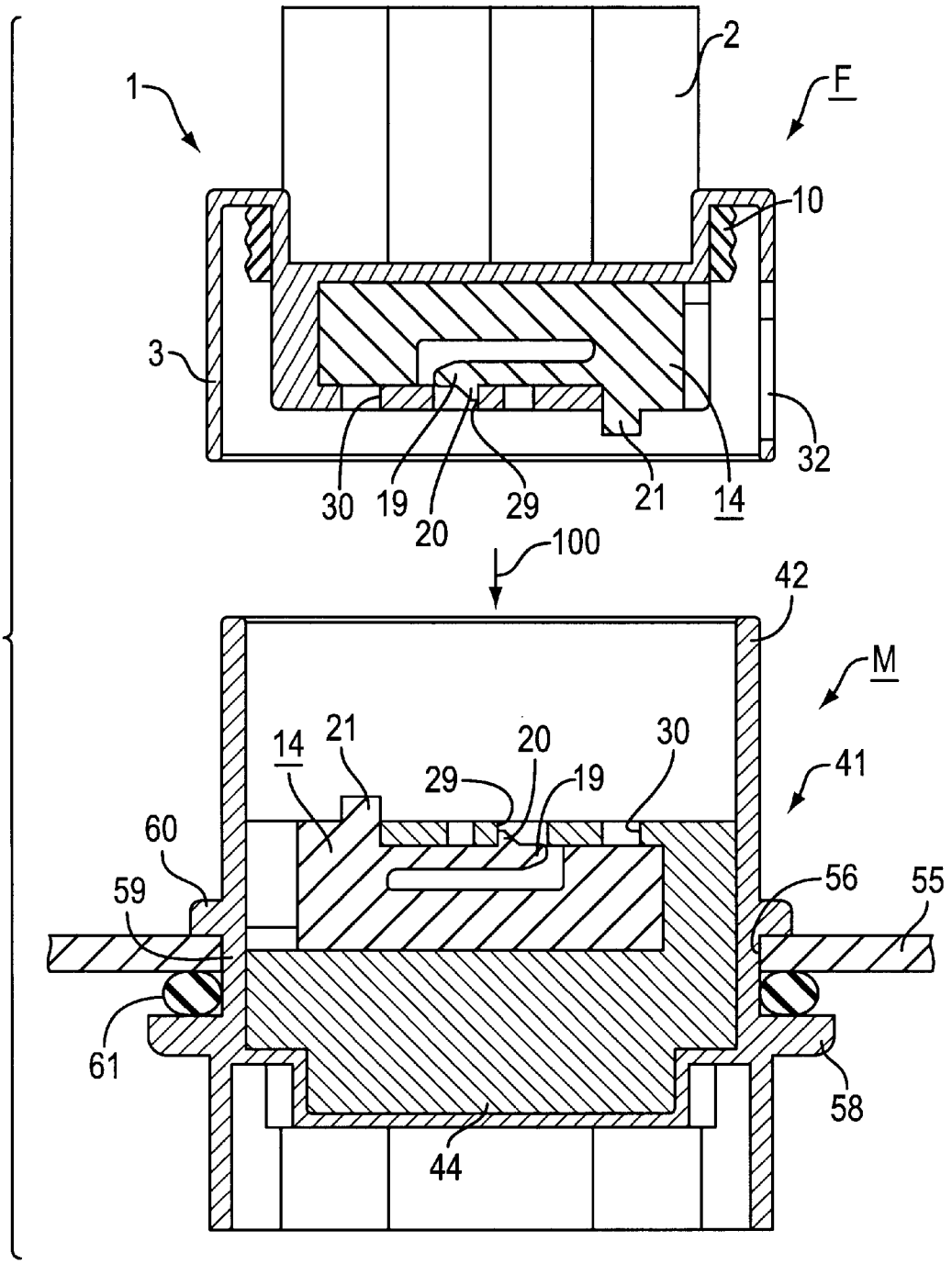
FIG. 15 is a cross-sectional view showing the two connectors being fitted together.
Figure 16:
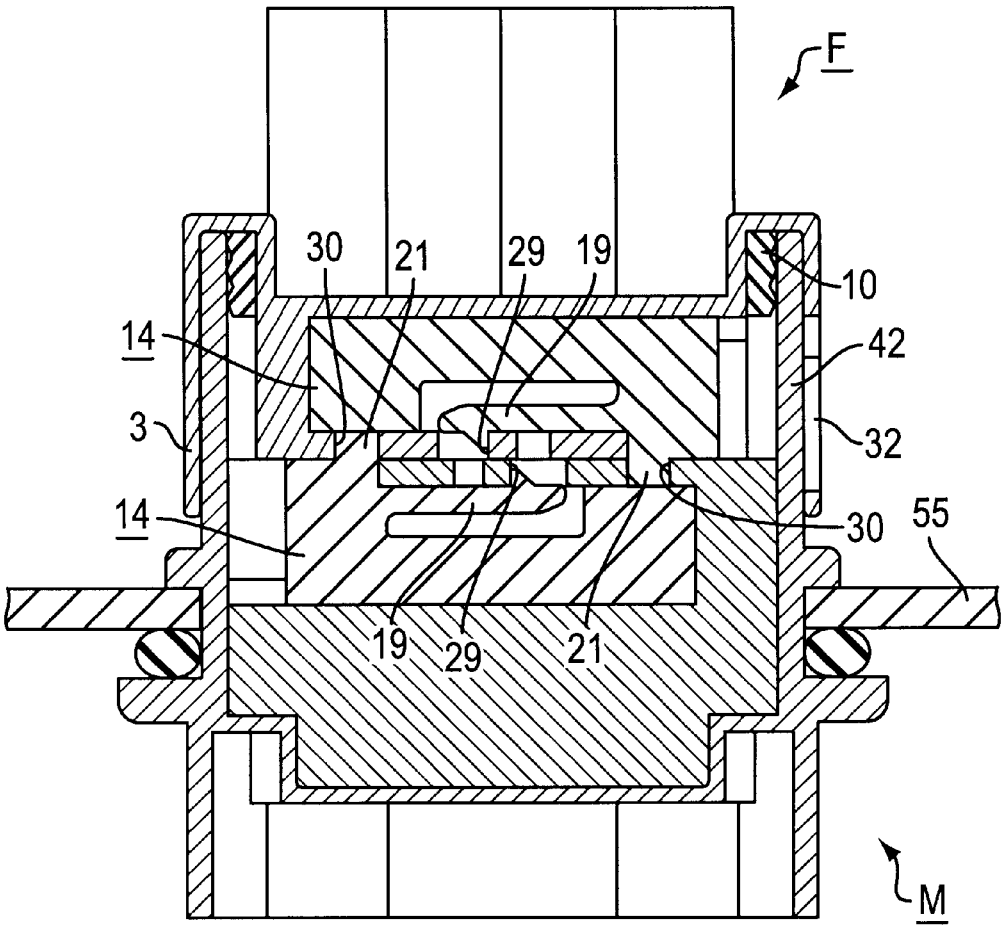
FIG. 16 is a cross-sectional view showing the two connectors in a correctly fitted state.

The assembly of the male connector M is thus completed, the protruding members 60 are fitted into the recessed grooves provided on the hole edge of the attachment hole 56 of the panel 55, the circular wall 59 is pushed into the attachment hole 56, and the flange 58, separated by packing 61, is rotated on its axis at a protruding point of the panel 55 and, as shown in FIG. 15, the flange 58 and the protruding members 60 tightly grip inner and outer opening edges of the attachment hole 56, thereby fixing the male connector M to the panel 55.

The female connector F is assembled as follows. First, the retainer 14 is inserted into the retainer insertion groove 23 of the housing main body 2 via the window 32 of the hood member 3 and is maintained in the temporary stopping position shown in FIG. 6. In this temporary stopping position, as shown in FIG. 8, the stopping protrusions 17A and 17B of the base plate 15 of the retainer 14 are in a state whereby they are moved away from the cavities 5A and 5B, and are consequently in a state whereby the female terminal fittings 6A and 6B can be inserted. In this state, the small and large female terminal fittings 6A and 6B are inserted from the posterior into the upper and lower cavities 5A and 5B formed in the housing main body 2 and are housed therein while being stopped by the metal lances 7.

Figure 10:
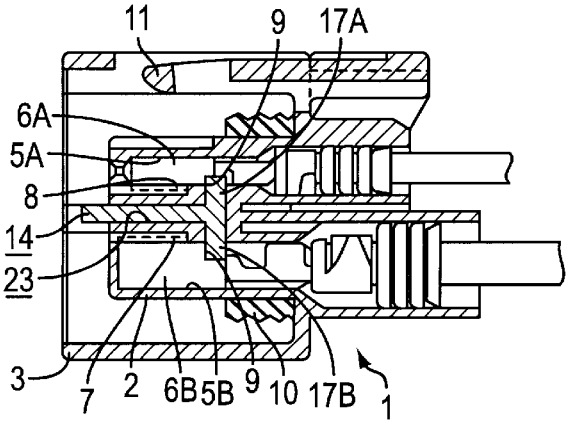
FIG. 10 is a vertical cross-sectional view of the retainer in the main stopping position.

After the insertion of the female terminal fittings 6A and 6B has been completed, a finger or a jig is inserted from the anterior face to engage the operating member 21 of the retainer 14, and the retainer 14 is moved to the main stopping position shown in FIG. 7. When this has been done, as shown in FIG. 9, the stopping protrusions 17A and 17B of the base plate 15 of the retainer 14 protrude into the cavities 5A and 5B and, as shown in FIG. 10, engage posterior faces of the stepped members 9 of the female terminal fittings 6A and 6B, thereby doubly stopping the female terminal fittings 6A and 6B in an unremovable state.

After the female connector F has been assembled in the manner described above, the female connector F is fitted with the male connector M attached to the panel 55, as shown by the arrow 100 in FIG. 15. As the female connector F is fitted, the locking arm 11 bends and the cylindrical fitting member 42 of the male housing 41 is inserted into the hood member 3 of the female housing I and, as the fitting approaches completion, the operating members 21 of the retainer 14 of the male connector M and the female connector F enter mutually into the corresponding detecting holes 30. When the two connectors F and M are correctly fitted together, the protrusion 43 on the male housing 41 fits into the stopping hole 12 of the locking arm 11, thereby locking the two connectors F and M in a fitted state (see FIG. 16). Moreover, the sealing ring 10 is gripped resiliently between the cylindrical fitting member 42 and the housing main body 2, thereby creating a seal between the two connectors F and M.

Figure 17:
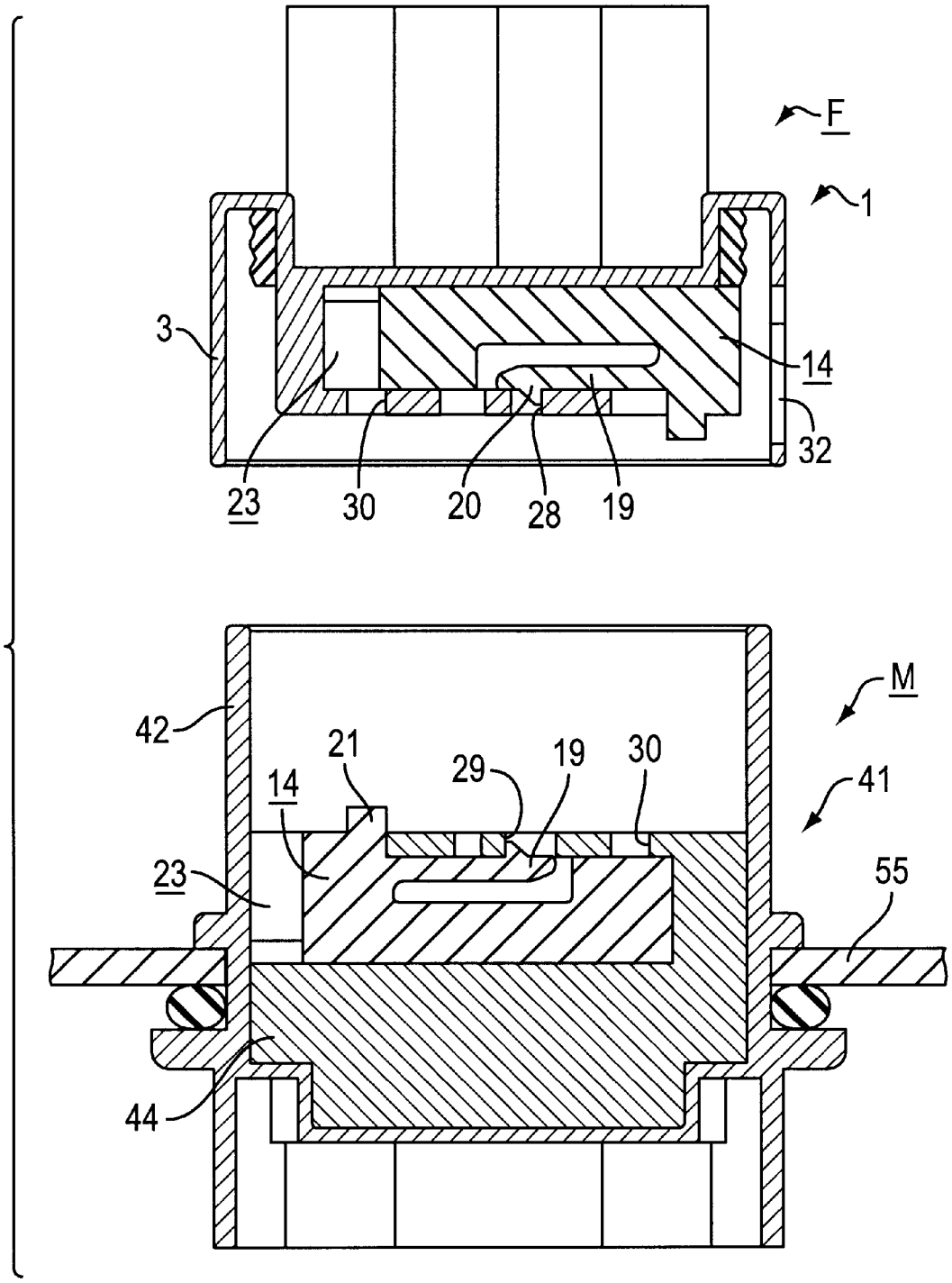
FIG. 17 is a cross-sectional view showing the retainer of the female connector remaining in the temporary stopping position while the fitting operation is taking place.

If one forgets to move the retainer 14 of the female connector F to the main stopping position, as shown in FIG. 17, and the two connectors F and M are fitted together while the retainer 14 is still in the temporary stopping position, the operating member 21 of the retainer 14 does not correspond with the corresponding detecting hole 30 and, as a result, the operating member 21 strikes against the anterior face of the terminal housing member 44 and cannot be fitted in the correct position. This can be confirmed by the inability to lock the locking arm 11. If this occurs, the two connectors F and M can be fitted together after the retainer 14 is moved to the main stopping position.

Further, in the case whereby the retainer 14 of the male connector M is left in the temporary stopping position, the operating member 21 of the retainer 14 will, in like fashion, fail to correspond with the corresponding detecting hole 30 and the operating member 21 will strike against the anterior face of the housing main body 2. As a result the two connectors F and M cannot be fitted together in the correct position and, as above, the fact that the retainer 14 is still in the temporary stopping position can be detected.

If the terminal fittings must be separated from the corresponding housings for maintenance, etc., this is performed in the following manner.

In the case of the female connector F, the lock of the locking arm 11 is released and it is pulled away from the male connector M. Then the operating member 21 of the retainer 14 is engaged by a finger or a jig from the anterior face and the retainer 14 is moved to the temporary stopping position. The engagement of the female terminal fittings 6A and 6B by the retainer 14 is thereby released and, consequently, the engagement of the metal lances 7 is released and the female terminal fittings 6A and 6B can be pulled out towards the posterior.

In the case of the male connector M, the male connector M is separated from the panel 55 and then, as above, the operating member 21 of the retainer 14 is engaged by a finger or a jig from the anterior face and the retainer 14 is moved to the temporary stopping position. The stopping of the male terminal fittings 66A and 66B by the retainer 14 is thereby released and, consequently, the stopping of the metal lances 67 is released and the male terminal fittings 66A and 66B can be pulled out towards the posterior.

The embodiment described above has the following advantages. In the case of the female connector F, the configuration whereby the retainer 14 is inserted into the retainer insertion groove 23 formed within the housing main body 2 means that the retainer 14 can be miniaturised and, consequently, the entire female connector F can be miniaturised. The window 32 allowing the insertion of the retainer 14 opens onto the hood member 3; however, a miniaturised retainer 14 means that the opening area of the window 32 can remain small. Moreover, when the two connectors F and M have been fitted together, this window 32 is covered by the cylindrical fitting member 42 of the corresponding male connector M and, moreover, the window 32 is located to the anterior of the space between the female connector F and the male connector M sealed by the sealing rings 10. As a result, water will not enter via the window 32.

The retainer 14 can be attached to the female housing 1 in the temporary stopping position before the female terminal fittings 6A and 6B are attached, and handling is consequently simpler.

Furthermore, in the conventional configuration in which the retainer covers the outer circumference of the housing, if temporary stopping and main stopping is to be performed, two locking members must be provided at each of two locations corresponding to the temporary stopping position and main stopping position. The configuration is therefore complicated and, moreover, there is the danger that the lock may not be totally effective. In the present embodiment, the locking mechanism is provided at the interior of the housing main body, and consequently only one locking member needs to be provided at the temporary stopping position and main stopping position respectively. Consequently the configuration is simpler and the likelihood of the lock not being fully effective is reduced.

The operating member 21 of the retainer 14 protrudes to the anterior face of the housing main body 2 and, as a result, this operating member 21 can be seen from this wide open anterior side, and the retainer 14 an be moved therefrom with a jig or a finger. Consequently, the retainer 14 can be moved simply and reliably.

The operating member 21 of the retainer 14 also acts as a detecting member which detects whether the retainer 14 has been moved correctly to the main stopping position. Consequently, the operating member 21 has both a simple configuration and can detect the position of the retainer 14.

This miniaturisation of the retainer 14, the simple configuration of the lock, the simplicity of moving the retainer 14, and the ability to detect the position of the retainer 14, are all advantages which apply to the male connector M also.

The present invention is not limited to the embodiments described above with the aid of figures. For example, the embodiments described below also lie within the technical range of the present invention. In addition, the present invention may be embodied in various other ways without deviating from the scope thereof.

(1) The present invention also includes the possibility that the retainer may not be maintained in the temporary stopping position, but may be inserted to the main stopping position immediately after the terminal fittings have been inserted.

(2) If the operating member of the retainer does not serve the function of detecting position as well, the operating member need not protrude to the anterior face of the housing main body.

What is claimed is:

1. An electrical connector comprising a housing having a plurality of parallel terminal cavities therein, each of said cavities being adapted to receive one of a plurality of electrical terminals, the housing having a retainer cavity intersecting said terminal cavities, and a retainer within said retainer cavity and movable between a first position in which in use said terminals can move in respective terminal cavities, and a second position in which said terminals are in use latched in respective terminal cavities, and the housing further including a hood extending parallel to said terminal cavities and surrounding said housing at a distance to define an annular chamber adapted to receive a corresponding annular projection of a mating housing, said hood having a window therein, aligned with said retainer cavity and adapted to receive said retainer therethrough.

2. A connector according to claim 1 wherein said retainer and retainer cavity further define a releasable latch, the retainer being latchable in said retainer cavity in both said first and said second position.

3. A connector according to claim 1 wherein said retainer and retainer cavity have a substantially 'T' shaped section.

4. A connector according to claim 1 wherein on one side of said window the annular chamber has a mouth to receive the corresponding annular projection of the mating housing, and on the other side of said window the annular chamber contains a close fitting annular seal adapted to engage said projection.

5. A connector according to claim 4 wherein said annular chamber is closed at the end opposite said mouth, and said seal abuts the said end.

6. A connector according to claim 1 wherein said retainer has terminal stopping members thereon, said stopping members being at the side of said cavities in the first position of the retainer, and protruding into said cavities in the second position of said retainer.

7. A connector according to claim 6 wherein said retainer is castellated.

8. A connector according to claim 1 wherein said retainer further includes a discontinuity thereon, said discontinuity being accessible from the exterior of said housing to permit the retainer to be reciprocated between said first and second positions.

9. A connector according to claim 8 wherein said discontinuity comprises a protrusion extending parallel to said insertion cavities.

10. An electrical connector assembly comprising a first connector according to claim 9 and a mating second connector having a plurality of terminals engageable in said first connector, said second connector defining an aperture adapted to receive said protrusion only in the second position of said retainer, said protrusion otherwise preventing complete engagement of the first and second connectors.

* * * * *